US007497768B2

(12) United States Patent
Minick et al.

(10) Patent No.: US 7,497,768 B2
(45) Date of Patent: Mar. 3, 2009

(54) FLEXIBLE ABRASIVE ARTICLE AND METHOD OF MAKING

(75) Inventors: Chris A. Minick, Stillwater, MN (US); Ian R. Owen, Baldwin, WI (US); Steven J. Tarnowski, Mahtomedi, MN (US)

(73) Assignee: 3M innovative Properties Company, St. Paul, MN (US)

( * ) Notice: Subject to any disclaimer, the term of this patent is extended or adjusted under 35 U.S.C. 154(b) by 125 days.

(21) Appl. No.: 11/201,704

(22) Filed: Aug. 11, 2005

(65) Prior Publication Data

US 2007/0037500 A1 Feb. 15, 2007

(51) Int. Cl.
*B24D 11/00* (2006.01)

(52) U.S. Cl. ..... 451/527; 451/539; 451/533

(58) Field of Classification Search ..... 451/539, 451/523, 524, 525, 527, 528, 529, 533, 921
See application file for complete search history.

(56) References Cited

U.S. PATENT DOCUMENTS 4,111,666 A * 9/1978 Kalbow ..... 51/295
4,202,139 A 5/1980 Hong et al.
4,714,644 A 12/1987 Rich
4,960,442 A * 10/1990 Wagner et al. ..... 51/295
4,996,800 A * 3/1991 Mangus ..... 451/28
5,707,903 A 1/1998 Schottenfeld
5,849,051 A 12/1998 Beardsley et al.
6,613,113 B2 9/2003 Minick et al.
6,848,977 B1 * 2/2005 Cook et al. ..... 451/41
6,923,840 B2 * 8/2005 Schutz et al. ..... 51/307
2003/0121212 A1 7/2003 Minick et al.

FOREIGN PATENT DOCUMENTS

GB 1247103 9/1971

* cited by examiner

*Primary Examiner*—Robert Rose
(74) *Attorney, Agent, or Firm*—David B. Patchett

(57) ABSTRACT

A flexible hand-held abrasive article includes a conformable backup pad having opposed major surfaces, a backing layer affixed to one surface of the backup pad, the backing layer containing a plurality of biaxially oriented openings, and abrasive particles arranged on the backing layer, thereby defining an abrasive surface. A method of making such an abrasive article is also disclosed. The abrasive article may also comprise a backing layer containing a plurality of biaxially oriented slits with abrasive particles arranged at least one surface of the backing layer.

1 Claim, 4 Drawing Sheets

FLEXIBLE ABRASIVE ARTICLE AND METHOD OF MAKING

BACKGROUND

The present invention relates generally to abrasive articles for abrading a work surface and, more particularly, to flexible abrasive articles.

Sheet-like abrasive articles are commonly used in a variety of sanding operations including hand sanding of wooden surfaces. In hand sanding, the user holds the abrasive article directly in his or her hand and moves the abrasive article across the work surface. Sanding by hand can, of course, be an arduous task.

Sheet-like abrasive articles include, for example, conventional sandpaper and resilient sanding sponges. Conventional sandpaper is typically produced by affixing abrasive mineral to a relatively thin, generally non-extensible, non-resilient, non-porous backing (e.g., paper, film etc.). Conventional sandpaper typically exhibits good initial stock removal (i.e. cut) but produces a relatively deep scratch pattern for a given mineral size, and generally has an undesirably short life. The short life is due in part to the non-porous nature of the backing, which tends to trap the debris generated during sanding. This trapped debris often clogs the abrading surface of the sandpaper, thereby preventing any further stock removal. Additionally, the thin, flat, slippery nature of conventional sandpaper makes the article difficult to grasp, hold and maneuver, and does not make sandpaper well suited for sanding curved, contoured, or textured surfaces.

Conventional sanding sponges generally include a resilient backing that is easier and more comfortable to handle and use than conventional sandpaper. In addition, conventional sanding sponges produce a finer scratch pattern for a given mineral size than conventional sandpaper, but produce less cut. Commercially available resilient sanding sponges include 3M™ Sanding Sponges, 3M™ Softback Sanding Sponges, and 3M™ Flexible Sanding Sponges, all available from 3M Company, St. Paul, Minn.

U.S. Pat. No. 4,202,139 (Hong et al.), for example, discloses a flexible, hand-held sanding pad comprising a conformable, self-supporting pad having one major surface capable of providing temporary adhesive attachment for a sheet of pressure-sensitive adhesive-coated abrasive material and a handle means for maintaining the pad in contact with the hand of the user during use.

U.S. Pat. No. 4,714,644 (Rich) discloses a sanding pad comprising a stiff rectangular backing sheet having through slits along closely spaced parallel lines, with the slits along each line forming most of the line and being spaced by a plurality of unslit parts of the sheet. A coating of abrasive granules is adhered along a first surface of the sheet, and a layer of resiliently compressible foam is adhered on and coextensive with a second surface of the backing sheet.

U.S. Pat. No. 5,849,051 (Beardsley et al.) discloses abrasive foam articles comprising a flexible and resilient foam substrate having first and second major substrate surfaces, at least one of the surfaces having a plurality of open cells substantially across the substrate surfaces, the open cells having coatable surfaces defined by interconnected voids; and a plurality of abrasive particles adhered to the coatable surface of the open cells in a substantially uniform manner.

U.S. Pat. No. 6,613,113 (Minick et al.) discloses a flexible abrasive product comprising a flexible sheet-like substrate comprising a multiplicity of separated resilient bodies connected to each other in a generally planar array in a pattern which provides open spaces between adjacent connected bodies, each body having a first surface and an opposite second surface; and abrasive particles to cause at least the first surface to be an abrasive surface.

The industry is always seeking improved conformable flexible abrasive articles that are more durable, are easier to handle and use, have improved cut, produce finer scratches, and have a longer life. It would be desirable to provide a flexible resilient abrasive article that has improved durability over a wide range of abrasive grit sizes, has improved flexibility, has improved handling and is therefore is easy and comfortable to use, is easy and inexpensive to make, has improved cut, produces finer scratches than a comparable sheet of sandpaper, and lasts longer.

SUMMARY

The present invention provides a flexible resilient abrasive article with improved durability over a wide range of abrasive grit sizes, improved flexibility, improved handling and is therefore easy and comfortable to use, improved cut, produces finer scratches than a comparable sheet of sandpaper, is easy and inexpensive to make, and/or lasts longer than other flexible resilient abrasive articles. In particular, the present invention provides a flexible sheet-like abrasive article containing a plurality of biaxially oriented openings. The expression "sheet-like" refers generally to the broad, thin, flexible nature of the abrasive article.

In one embodiment, the abrasive article is a unitary article comprising a backing layer in the form of a single layer having at least one abrasive surface, wherein the backing layer contains a plurality of openings in the form of biaxially oriented slits. The term "slits" refers generally to narrow elongated openings formed, for example, by incisions or by otherwise cutting or tearing the backing layer. In another embodiment, the abrasive article has a laminated or multilayer construction including a backing layer and a backup pad, and at least the backing layer contains a plurality of biaxially oriented openings. In the case of a laminated construction, the openings may be in the form of slits or other types of openings such as pierced or punched holes.

In the case of a unitary or single backing layer construction, the backing layer may be a generally non-resilient sheet-like material formed of, for example, paper, film or cloth, or the abrasive article may have a generally resilient backing formed of, for example, foam, felt, or a non-woven material. In the case of a laminated construction, the backing layer and backup pad my include combinations of these materials. In either case, the openings may extend either partially or entirely through the abrasive article.

In accordance with a more specific aspect of the invention, the present invention provides a resilient hand-held abrasive article or sanding pad including a conformable backup pad having opposed major surfaces, an abrasive backing layer containing a plurality of biaxially oriented openings affixed to the backup pad, and abrasive particles arranged on the backing layer, thereby defining an abrasive surface. In various more specific embodiments of the invention, the openings may comprise a plurality of slits, the slits may be provided in a regular repeating pattern or array, the slits may be provided in a rectilinear grid, and the slits may comprise a first set of parallel rows, each row including a plurality of aligned spaced slits, and a second set of parallel rows arranged generally perpendicular to the first set of parallel rows including a plurality of aligned spaced slits.

In one embodiment, the backup pad comprises a closed-cell foam. In a more specific embodiment, the backup pad includes a plurality of separated resilient bodies held together in a pattern so as to provide openings between each adjacent separated body yet connected to one another at contact points.

In another embodiment, the abrasive backing layer comprises a woven or cloth material. In a specific embodiment, the backing is a J-weight woven cloth. In a specific aspect of the invention, the abrasive particles have a minimum grit size of about 180.

In a specific aspect, the present invention provides a resilient, flexible, sheet-like hand-held abrasive article including a conformable backup pad formed of a closed-cell polyvinylchloride foam comprising a multiplicity of separated resilient bodies connected to each other in a generally planar array in a pattern which provides open spaces between adjacent connected bodies, a woven backing layer attached to the backup pad, the backing layer containing a plurality of biaxially oriented slits, and abrasive particles affixed to the backing layer, thereby defining an abrasive surface. In a more specific aspect, the slits are curved lines.

The present invention also provides a method of making an abrasive article comprising the steps of providing an abrasive sheet comprising a backing layer having first and second opposed major surfaces with an adhesive make coat layer on the first surface and abrasive particles arranged in the make coat layer, applying an adhesive to the second surface of the backing layer, laser cutting the second surface of the abrasive sheet to form a plurality of biaxially oriented slits in the backing layer. The method may further include the step of bonding the abrasive sheet to a closed-cell foam backup pad.

Advantages of certain embodiments of the invention include improved cut, improved flexibility, reduced scratch, reduced loading, and greater durability over a wider range of abrasive grit sizes.

BRIEF DESCRIPTION OF THE DRAWINGS

The present invention will be further described with reference to the accompanying drawings, in which:

FIGS. 7*a-j* are schematic plan views showing alternate patterns for the openings in the abrasive article.

DETAILED DESCRIPTION

Figure 1:
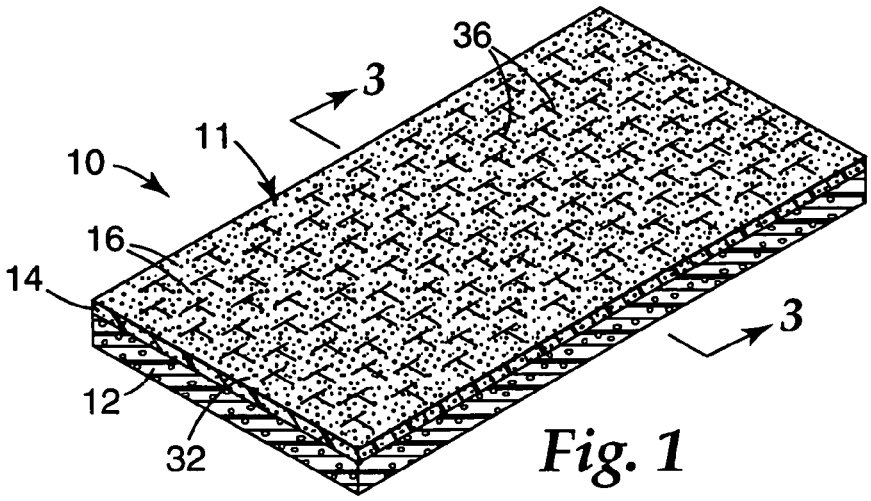
FIG. 1 is a perspective view of a flexible resilient abrasive article according to the invention.

Referring now to the drawings, wherein like reference numerals refer to like or corresponding features throughout the several views, FIGS. 1-4 show a flexible resilient abrasive article 10 comprising an abrasive sheet 11 and an optional backup pad 12. The abrasive sheet 11 includes an abrasive backing layer 14 which is affixed to the backup pad 12, a make coat layer 18 (FIG. 3) on the abrasive backing layer 14, and a plurality of abrasive particles 16 at least partially embedded in the make coat layer 18. The backup pad 12, abrasive backing 14, abrasive particles 16 and make coat 18 are each described in detail below.

Backup Pad

The optional backup pad 12 is typically formed of a resilient or conformable material. The backup pad 12 is desirable because it provides a comfortable gripping surface for the user and improves the conformability of the abrasive article, thereby allowing the abrasive article 10 to more effectively sand curved and contoured surfaces. In addition, the backup pad 12 provides support for the backing layer 14, thereby improving the overall durability of the abrasive article 10.

In general, any resilient material may be used in the abrasive article of the invention. Suitable materials include open-cell foam, closed-cell foam, and reticulated foam, each of which can further include an outer skin layer. Suitable foam materials for the backup pad 12 include, for example, synthetic polymer materials, such as polyurethanes, polyvinylchloride (PVC), foam rubbers, and silicones, and natural sponge materials.

In one aspect of the invention, the backup pad 12 is formed of a closed-cell foam. Closed-cell foam is desirable because of its toughness and durability. The thickness of the backup pad 12 is only limited by the desired end use of the abrasive article. Preferred backup pad thicknesses range from about 1 mm to about 15 mm, although backup pads having a greater thickness may also be used. Thin backup pads are typically desirable if the abrasive article is to be installed on and used with a sanding tool because thin backup pads can typically be more readily installed on such tools.

The backup pad 12 may be continuous or discontinuous. A continuous backup pad is one that does not contain holes, voids, or channels extending there through in the Z-direction (i.e. the thickness or height dimension) that are larger than the randomly formed spaces between the material itself when it is made. A discontinuous backup pad, on the other hand, contains openings extending there through in the Z-direction.

Suitable continuous foam materials are available from Voltek, LLC, Lawrence Mass., under the trade name Volextra. These materials are cross-linked, closed-cell, polyolefin foams. Suitable discontinuous foam materials are available under the trade names OMNI-GRIP, MAXI-GRIP, ULTRA GRIP, EIRE-GRIP, and LOC-GRIP from Griptex Industries, Inc. of Calhoun, Ga.

Figure 2:
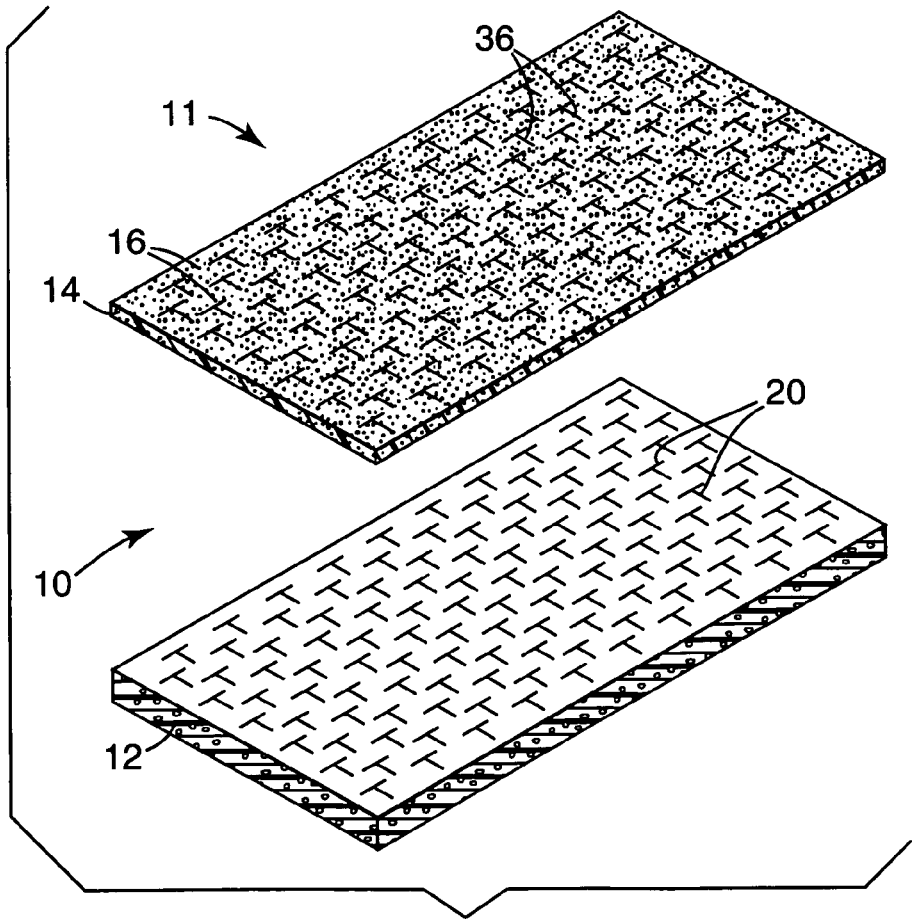
FIG. 2 is an exploded view of the resilient abrasive article of FIG. 1.
Figure 3:
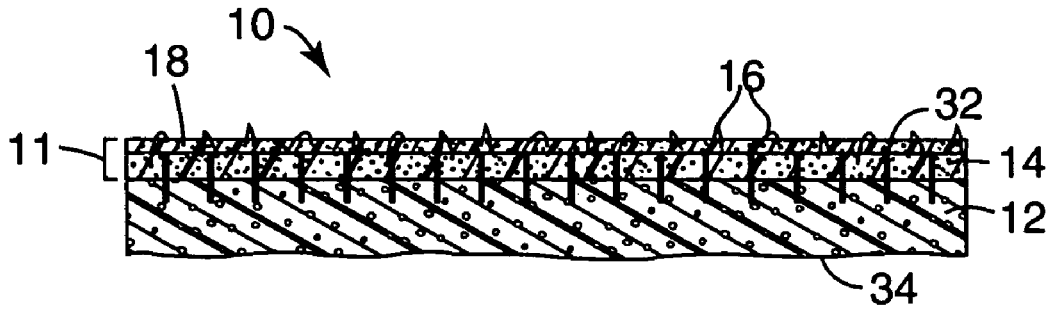
FIG. 3 is a cross-sectional view taken along line 3-3 of FIG. 1.

As shown in FIGS. 2 and 3, the backup pad 12 may include slits or perforations 20 to improve the conformability and flexibility of the abrasive article 10. The slits or perforations 20 may extend only partially through the backup pad 12, such that the backup pad 12 is still continuous as shown in FIG. 3, or the slits or perforations 20 may extend completely through the backup pad, such that the backup pad 12 is discontinuous. The slits or perforations 20 may be mirror the openings described below in connection with the backing 14. That is, the slits 20 in the backup pad 12 may have the same size, shape, and pattern as those provided in the backing 14.

Figure 4:
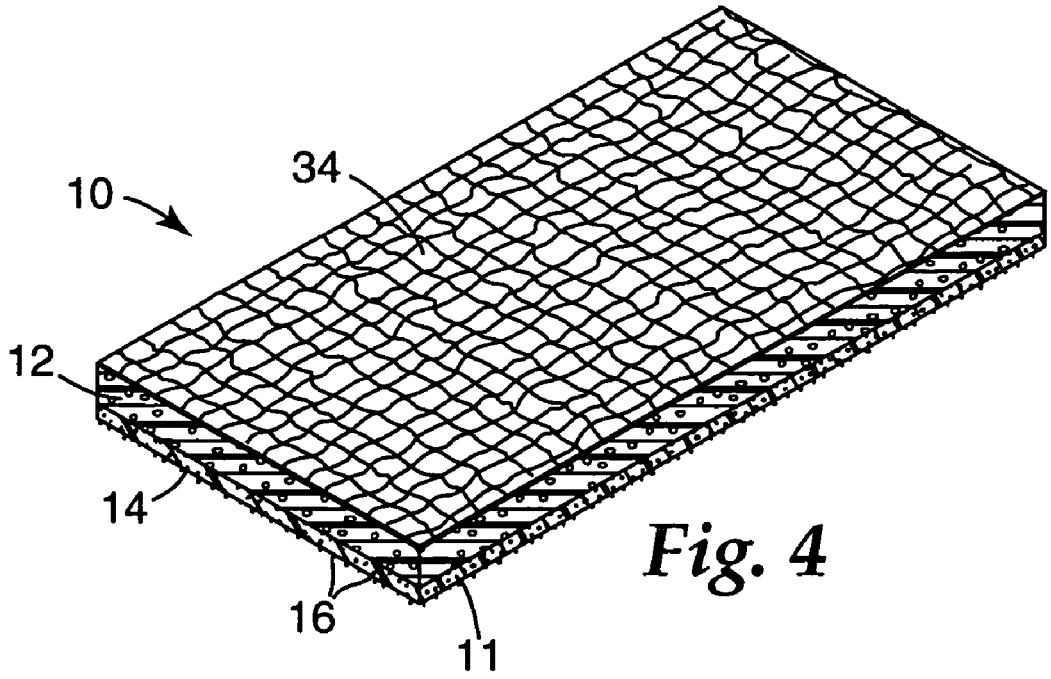
FIG. 4 is a perspective bottom view of the abrasive article of FIG. 1.

As shown in FIG. 4, the exposed (or bottom) surface 34 of the backup pad 12 (i.e. the surface that is not attached to the backing 14), optionally includes a textured, embossed, contoured, or otherwise macroscopically three-dimensional surface topography to enhance a user's ability to grip or hold the abrasive article 10 as it is moved across a work surface.

Figure 5:
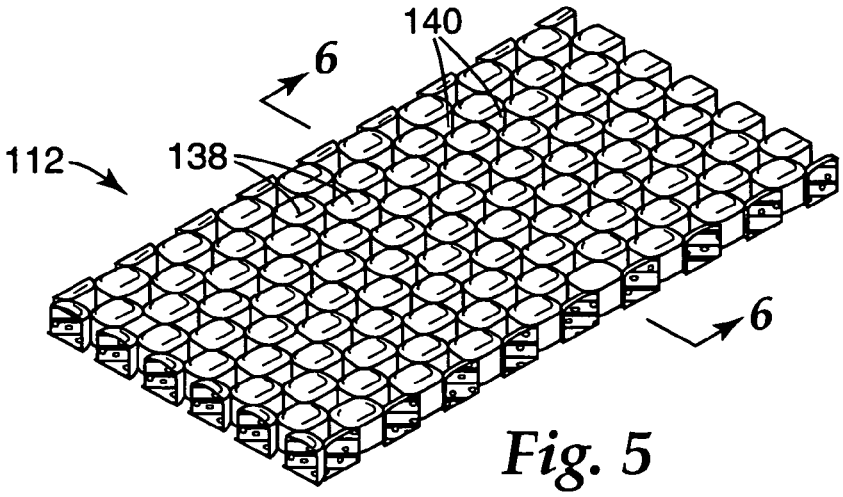
FIG. 5 is a perspective view of an alternate backup pad.
Figure 6:
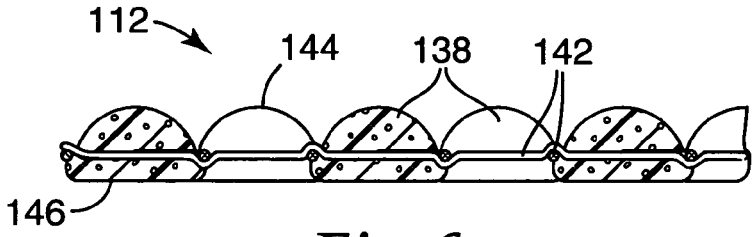
FIG. 6 is a cross-sectional view taken along line 6-6 of FIG. 5.

FIGS. 5 and 6 show a preferred backup pad 112 having an open structure. The backup pad 112 is formed of a plurality of separated resilient bodies 138 which are held together in a pattern so as to provide openings 140 between each adjacent separated body yet connected to one another at contact points. While such backup pads may be formed by appropriate die cutting of a continuous or solid sheet of rubber or a sheet of foam material, the illustrated backup pad 112 includes a scrim 142 including parallel threads and cross-parallel threads typically in a grid pattern which provides openings, every other one of which is closed by a resilient body in an offset pattern.

Each resilient body 138 may include a first surface 144 which is preferably convex or domed, and a second surface 146 which is preferably flat, thereby to allow the backup pad 112 to be more readily attached to the backing 14. The collection of second surfaces provides an easily handleable backside of the abrasive article which easily conforms to the hand of a user to provide a convenient deformable product which is easily utilized to abrade surfaces which have a complex shape.

Suitable materials for an open back-up pad such as those described above are commercially available under the trade names OMNI-GRIP, MAXI-GRIP, ULTRA GRIP, EIRE-GRIP, and LOC-GRIP from Griptex Industries, Inc. of Calhoun, Ga. Such products may be made according to U.S. Pat. No. 5,707,903 (Schottenfeld), the entire contents of which are hereby incorporated by reference.

Such materials are formed by dipping a scrim into a liquid composition that is curable to form a polyvinylchloride (PVC) foam. The scrim may be made of natural or synthetic fibers which may be either knitted or woven in a network having intermittent openings spaced along the surface of the scrim. The scrim need not be woven in a uniform pattern but may also include a nonwoven random pattern. Thus, the openings may either be in a pattern or randomly spaced. The scrim network openings may be rectangular or they may have other shapes including a diamond shape, a triangular shape, an octagonal shape or a combination of these shapes.

Preferably the scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies. The scrim may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The composition of the resilient bodies may either be foamed or non-foamed, and may be composed of any of a variety of elastomeric materials including, but not limited to, polyurethane resins, polyvinyl chloride resins, ethylene vinyl acetate resins, synthetic or natural rubber compositions, acrylate resins and other suitable elastomeric resin compositions.

Such backup pads are characterized by having open areas between resilient bodies to provide cumulative open areas as compared to the total area of the resilient body on the order of about 20% to about 80%, more preferably, between about 30% to about 60%.

The backup pad 112 has a sufficient thickness to make it convenient for being hand-held and to provide a comfortable grip. The thickness is measured between the highest point of the first surface of the resilient body to the second surface of the resilient body. The thickness preferably is between about 1 mm and about 15 mm, more preferably about 3 mm to about 10 mm.

While a square or rectangular shape of the resilient body is preferred, the bodies may be any convenient geometric shape including, but not limited to, square, rectangular, triangular, circular, and in the shape of a polygon. The resilient bodies are preferably uniform in shape, but they need not be. The resilient bodies may be aligned in rows longitudinally and in a transverse direction but for some applications it may be preferable that they not be aligned because in sanding operations where the abrasive product is moved in only one direction, for example, the longitudinal direction, longitudinally aligned abrasive covered resilient bodies could produce an unwanted scratch pattern in the surface being abraded.

The dimensions of the resilient bodies 138 may vary from about 2 to about 25 mm, preferably from 5 to 10 mm. "Each dimension" refers to the dimension of a side, if rectangular, the diameter, if circular or the maximum dimension if of an irregular shape. The shapes of the resilient bodies 138 need not be a defined shape but could be randomly shaped. When referring to the dimensions of the resilient body, the dimensions are intended to include the widths in the longitudinal or transverse direction or the maximum dimension of the body when measured from one side to the other notwithstanding any direction.

The openings 140 in the backup pad 112 are generally individually smaller than the adjacent resilient body 138 and may have dimensions on the order of about 2 mm to about 25 mm, preferably of about 5 mm to about 10 mm. The openings 140 may be somewhat rectangular, if the resilient bodies 138 are rectangular, or the openings 140 may take any other configuration depending on the shape of the adjacent resilient bodies 138. The shape of the openings 140 is typically defined by the shape of the edges of the resilient bodies 138. The resilient bodies 138 and the openings 140 are generally uniformly distributed throughout the entire area of the flexible abrasive article of the invention but this is not necessary in all cases.

Backing

The abrasive backing layer 14 may be formed from a variety of commonly available materials including, for example, paper, knitted or woven fabric materials or cloth, fibrous nonwoven webs, polymeric films such as a thermoplastic film, foam materials or laminates thereof. The particular backing material will have sufficient strength for handling during processing, sufficient strength to be used for the intended end use application, the ability to have the make coat 32 transferred to at least one of its major surfaces, and is able to be affixed to the backup pad 12. The abrasive backing layer 14 may be adhesively bonded to the backup pad 12 using, for example, a pressure-sensitive adhesive, a hot melt adhesive, a thermosetting adhesive, by flame bonding, or by other known techniques.

In the embodiment illustrated in FIGS. 1-4, the abrasive backing layer 14 is affixed to a backup pad 12 and contains a plurality of openings 36. The openings 36 are biaxially oriented slits that serve to improve the overall flexibility of the abrasive article 10. That is, the biaxially oriented slits 36 serve to improve the flexibility of the abrasive article 10 in the x-direction, the y-direction, and the z-direction. The slits typically have a length of from about 1 millimeters (mm) to about 10 mm, more typically from about 2 mm to about 8 mm, and even more typically from about 3 mm to about 6 mm.

In another aspect of the invention, the backing 14 is a cloth material. Cloth materials are desirable because they are generally tear resistant and are more durable than paper and film materials. In addition, cloth backings tolerate repeated bending and flexing during use. Cloth backings are generally formed of woven cotton or synthetic yarns that are treated to make them suitable for use as a coated abrasive backing. A preferred cloth backing is a J-weight cloth backing.

As shown in FIGS. 7*a-j*, the openings 36 may be provided in a wide variety of sizes, shapes, densities, and patterns. The openings 36 may be arranged in a regular pattern or arranged randomly. Each of the abrasive articles depicted in FIGS. 7*a-j* may further include a backup pad which may also be provided with openings.

Figure 7A:
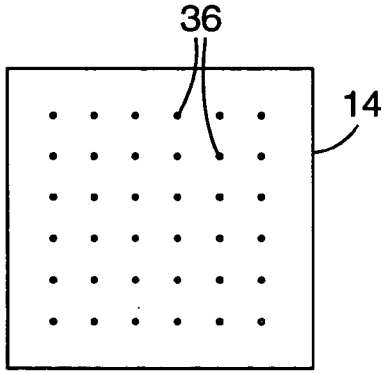
Figure 7B:
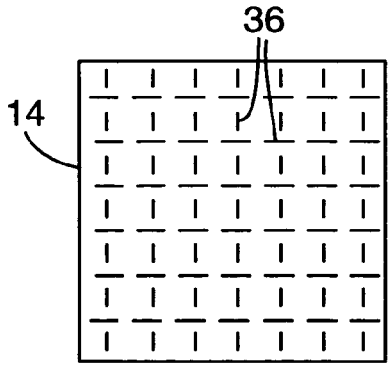
Figure 7C:
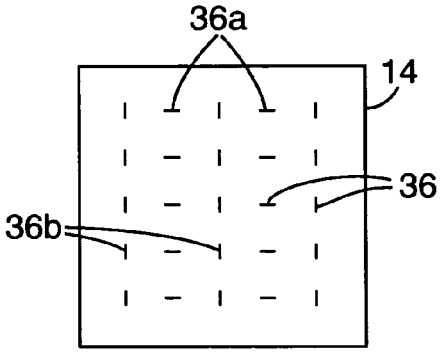

FIG. 7*a* shows a backing 14 containing openings 36 in the form of small pierced holes that may extend either partially or entirely through the backing 14. The holes are arranged in a series of aligned horizontal rows and a series of vertical columns that are generally perpendicular to the rows. In FIG. 7*b*, the openings 36 comprise slits in the form of straight lines. It will recognized that the slits 36 may also be, for example, curved or otherwise made to be non-linear. The slits 36 are arranged in a series of horizontal rows in which the slits within each row are oriented in the same direction (that is, all of the slits within a row are oriented either vertically or horizontally), and a series of vertical columns in which the slits within each column alternate between vertical and horizontal. In FIG. 7*c*, the openings 36 within each of the horizontal rows alternate between horizontally oriented slits 36*a* and vertically oriented slits 36*b*, and the slits within each of the vertical columns are oriented in the same direction.

Figure 7D:
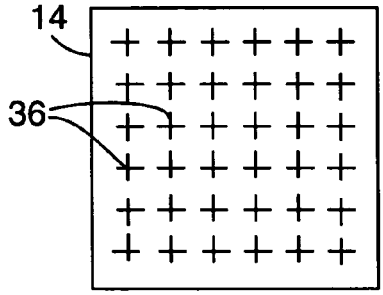
Figure 7E:
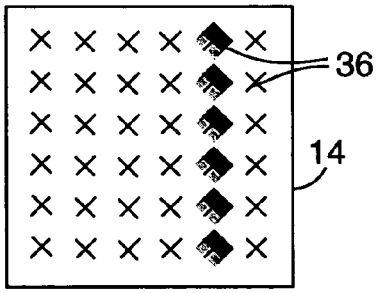

In FIG. 7*d*, each horizontal and vertical series of aligned slits 36 includes a pair of intersecting slits that form a "+" shape. That is, each horizontal row includes both a series of horizontally oriented slits and a series of vertically oriented slits which intersect the horizontally oriented slits, and each vertical column also includes both a series of horizontally oriented slits and a series of vertically oriented slits which intersect the horizontally oriented slits. In FIG. 7*e*, each horizontal and vertical series of aligned slits 36 includes a pair of intersecting slits that form an "x" shape. That is, each horizontal row includes a series of diagonally oriented slits which are intersected by a series of oppositely oriented diagonal slits.

Figure 7F:
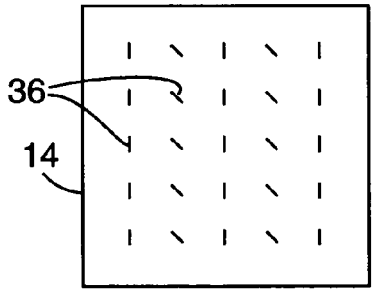
Figure 7G:
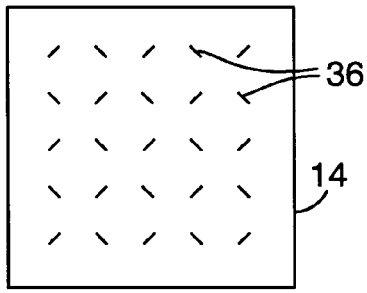

In FIG. 7*f*, the openings 36 are arranged in a series of horizontal rows in which the slits within each row are arranged in a slightly offset orientation (that is, the slits alternate between vertically and diagonally oriented slits with each successive diagonally oriented slit being oriented in the same direction as the previous diagonally oriented slit), and a series of vertical columns in which the slits within each column are oriented in the same direction (that is, the slits are either arranged vertically or in the same diagonal orientation). In FIG. 7*g*, each horizontal row includes alternating diagonal slits and each vertical column includes alternating diagonal slits.

Figure 7H:
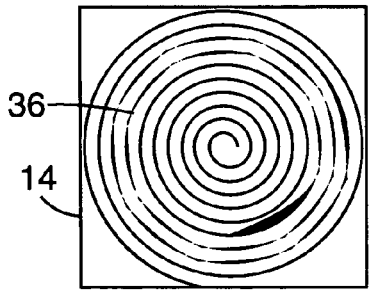
Figure 5I:
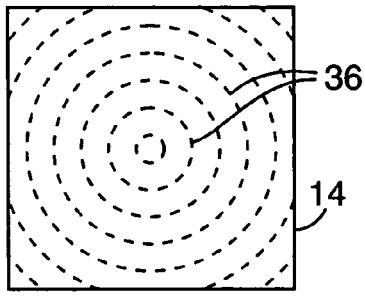

In FIG. 7*h*, the backing 14 includes one slit 36 in the form of a single continuous line in the shape of a spiral. In FIG. 7*i*, the slits 36 are arranged in concentric circles with each circle comprising spaced arcuate slits.

Figure 7J:
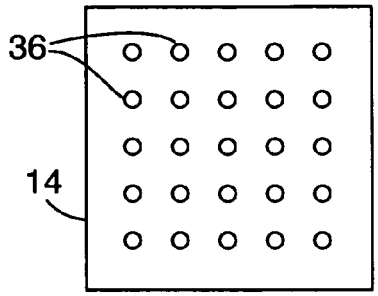

To maintain the largest abrasive surface area, the openings 36 are preferably formed without removing any material from the backing layer 14. That is, the openings are preferably formed by incisions or by cutting lines in the backing layer 14, poking holes in the backing, or otherwise piercing the backing layer 14 without removing any of the abrasive particles or any material from the backing layer 14 itself. The openings 36, however, may also be formed by removing a portion of the backing 14 to create open voids in the backing such as by punching holes in the backing. FIG. 7*j*, for example, shows openings 36 in the form of holes or open circles arranged in aligned rows and columns. The openings may, of course, be formed in other shapes such as squares, diamonds, triangles, etc.

The openings 36 in any of the embodiments described above may be formed using a variety of techniques such as die cutting, laser cutting, cutting with a knife, blade or slitter, or by using water jets or air jets.

Make Coat

In general, any make coat 18 may be used to adhere the abrasive particles 16 to the backing layer 14. "Make coat" refers to the layer of hardened resin over the backing 14 of the abrasive article 10. A preferred make coat is a phenolic resin. The make coat 18 may be coated onto the backing layer 14 by any conventional technique, such as knife coating, spray coating, roll coating, rotogravure coating, curtain coating, and the like. The abrasive article 10 may also include an optional size coat.

Abrasive Particles

In general, any abrasive particles may be used with this invention. Suitable abrasive particles include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. The abrasive particles can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto the make coat by any conventional technique such as electrostatic coating or drop coating.

It will be recognized that the abrasive backing layer 14, the abrasive particles 16, and make coat 18 may be provided in the form of a pre-formed (i.e., commercially available) abrasive sheet. That is, rather than providing an abrasive backing layer 14, coating the backing 14 with make coat 18, and depositing abrasive particles 16 on the make coat 18 to form an abrasive sheet, a finished abrasive sheet including a backing, make coat and abrasive particles may be provided. A suitable abrasive sheet is available under the product designation 900DZ-REG, from 3M Company, St. Paul, Minn. 900DZ-REG is an abrasive sheet having a J weight cloth backing, a phenolic make coat, and ceramic abrasive particles.

Additives

The make coat and/or the size coat may contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as known to those skilled in the art.

General Method of Making

The abrasive article 10 shown in FIGS. 1-4 may be made by first forming an abrasive sheet including a backing 14, a make coat 18, and abrasive particles 16. This may be accomplished by either providing a backing, coating it with make coat and depositing abrasive particles in the make coat, or by providing a finished abrasive sheet including a backing, make coat and abrasive particles, such as the product available from 3M Company, St. Paul, Minn. under the product description DZ900-REG described above.

An adhesive, such as a pressure-sensitive adhesive, may then applied to the back of the abrasive sheet (i.e., to the side opposite the surface coated with abrasive particles), thereby serving to bond the abrasive sheet to the backup pad 12. Slits 36 are then cut into the abrasive sheet. A preferred method of forming the slits 36 is by laser cutting. The slits 36 are preferably cut into the abrasive sheet from the back side (i.e., the side coated with adhesive opposite the abrasive particles). By laser cutting the slits into the back side of the abrasive sheet, any residue created during the cutting process will collect on the back side of the abrasive sheet where it will not interfere with the use of the product. That is, if the laser cutting is done from the front side of the abrasive sheet (i.e. the side with the abrasive particles), any residue created during the cutting process will collect on the front (i.e., the working face) of the abrasive sheet. This residue could subsequently be transferred to, and thereby contaminate, the work surface being sanded. The adhesively coated and slit abrasive sheet may then be adhesively bonded or laminated to a backup pad. The completed article may then be cut to the desired size.

In order that the invention described herein can be more fully understood, the following example is set forth. It should be understood that this example is for illustrative purposes only, and is not to be construed as limiting this invention in any manner.

EXAMPLE

An abrasive article was made according to the general method described above using a 900DZ-REG cloth abrasive sheet. The back side of the abrasive sheet was coated with a hot melt pressure-sensitive adhesive. Biaxially oriented slits were then laser cut into the abrasive sheet from the back side of the sheet. The slits were cut to the pattern shown in FIG. 1. The slit abrasive sheet was then adhesively bonded to a foam backup pad. The backup pad was a Volextra rubberized polyethylene closed-cell foam pad having a thickness of approximately ⅛ of an inch.

Persons of ordinary skill in the art may appreciate that various changes and modifications may be made to the invention described above without deviating from the inventive concept. For example, the slits may be provided in the form of straight lines as shown in FIGS. 7*b*-7*g*, or the slits may be curved, have a serrated, wavy or serpentine shape, or be provided in other shapes and patterns. Thus, the scope of the present invention should not be limited to the structures described in this application, but only by the structures described by the language of the claims and the equivalents of those structures.

What is claimed is:

1. A resilient, flexible, sheet-like hand-held abrasive article, comprising:

(a) a conformable backup pad formed of a closed-cell polyvinylchloride foam comprising a multiplicity of separated resilient bodies connected to each other in a generally planar array in a pattern which provides open spaces between adjacent connected bodies, each body having a first surface and an opposite second surface, wherein adjacent ones of the resilient bodies are separated from one another at the respective first surfaces and the respective second surfaces;

(b) a J-weight woven cloth backing layer attached to the backup pad, the backing layer containing a plurality of biaxially oriented slits; and (c) abrasive particles affixed to the backing layer, thereby defining an abrasive surface.

* * * * *